United States Patent [19]

Bradbury et al.

[11] Patent Number: 5,011,813

[45] Date of Patent: Apr. 30, 1991

[54] THERMAL TRANSFER PRINTING

[75] Inventors: Roy Bradbury, St. Helens; Peter A. Gemmell; Richard A. Hann, both of Ipswich, all of England

[73] Assignee: Imperial Chemical Industries PLC, London, United Kingdom

[21] Appl. No.: 495,414

[22] Filed: Mar. 19, 1990

[30] Foreign Application Priority Data

Mar. 23, 1989 [GB] United Kingdom ..... 8906821

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914; 503/227

[56] References Cited

U.S. PATENT DOCUMENTS 4,808,568 2/1989 Gregory et al. ..... 503/227

FOREIGN PATENT DOCUMENTS 0237737 12/1987 European Pat. Off. ..... 503/227

OTHER PUBLICATIONS

Patent Abstracts of Japan vol. 9, No. 152 (M-391)(1875) Jun. 27, 1985, & JP-A-60 27594 (Mitsubishi Kasei Kogyo K. K.), Feb. 12, 1985.

Patent Abstracts of Japan, vol. 10, No. 159 (M-486)(2215) Jun. 7, 1986, & JP-A-61 12393 (Mitsui Toatsu Kagaku K.K.), Jan. 20, 1986.

Patent Abstracts of Japan, vol. 12, No. 257 (M-719)(3104) Jul. 20, 1988, & JP-A-63 39380 (Mitsubishi Chem. Ind. Ltd.), Feb. 19, 1988.

European Search Report, Application No. 90 30 1765.

Annex to European Search Report, Application No. 90 30 1765.

*Primary Examiner*—Bruce H. Hess

*Attorney, Agent, or Firm*—Cushman, Darby & Cushman

[57] ABSTRACT

A thermal transfer printing sheet comprising a substrate having a coating comprising a mixture of dyes of 20–50% of Formula I and of 80–50% of Formula II.

I

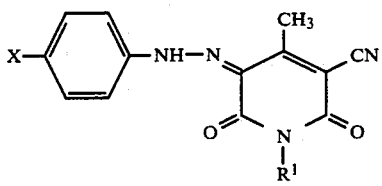

II

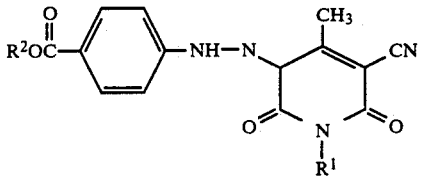

wherein:

$R^1$ is $C_{1-12}$-alkyl;

x is halogen; and $R^2$ is aryl or $C_{1-4}$-alkyl unsubstituted or substituted by $C_{1-4}$-alkoxy, $C_{1-4}$-alkoxy-$C_{1-4}$-alkoxy or aryl.

7 Claims, No Drawings

THERMAL TRANSFER PRINTING

INTRODUCTION

This invention relates to dye diffusion thermal transfer printing (DDTTP), especially to a DDTTP transfer sheet carrying a mixture of dyes and to the use of the transfer sheet in conjunction with a receiver sheet in a DDTTP process.

It is known to print woven or knitted textile material by a thermal transfer printing (TTP) process. In such a process a sublimable dye is applied to a paper substrate (usually as an ink also containing a resinous or polymeric binder to bind the dye to the substrate until it is required for printing) in the form of a pattern, to produce a transfer sheet comprising a paper substrate printed with a pattern which it is desired to transfer to the textile. Substantially all the dye is then transferred from the transfer sheet to the textile material, to form an identical pattern on the textile material, by placing the patterned side of the transfer sheet in contact with the textile material and heating the sandwich, under light pressure from a heated plate, to a temperature from 180°–220° C. for a period of 30–120 seconds.

As the surface of the textile substrate is fibrous and uneven it will not be in contact with the printed pattern on the transfer sheet over the whole of the pattern area. It is therefore necessary for the dye to be sublimable and vaporise during passage from the transfer sheet to the textile substrate in order for dye to be transferred from the transfer sheet to the textile substrate over the whole of the pattern area.

As heat is applied evenly over the whole area of the sandwich over a sufficiently long period for equilibrium to be established, conditions are substantially isothermal, the process is non-selective and the dye penetrates deeply into the fibres of the textile material.

In DDTTP, a transfer sheet is formed by applying a heat-transferable dye to a thin (usually <20 micron) substrate having a smooth plain surface (usually as an ink also containing a polymeric or resinous binder to bind the dye to the substrate) in the form of a continuous even film over the entire printing area of the transfer sheet. Dye is then selectively transferred from the transfer sheet by placing it in contact with a material having a smooth surface with an affinity for the dye, hereinafter called the receiver sheet, and selectively heating discrete areas of the reverse side of the transfer sheet for periods from about 1 to 20 milliseconds (msec) and temperatures up to 300° C., in accordance with a pattern information signal whereby dye from the selectively heated regions of the transfer sheet is transferred to the receiver sheet and forms a pattern thereon in accordance with the pattern in which heat is applied to the transfer sheet. The shape of the pattern is determined by the number and location of the discrete areas which are subjected to heating and the depth of shade in any discrete area is determined by the period of time for which it is heated and the temperature reached.

Heating is generally, though not necessarily, effected by a bank of pixels, over which the receiver and transfer sheet are passed together. Each pixel can be separately heated to 300° C. to 400° C., in less than 20 msec and preferably less than 10 msec, usually by an electric pulse in response to a pattern information signal. During the heating period the temperature of a pixel will rise from about 70° C. to 300°–400° C. over about 5–8 msec. With increase in temperature and time more dye will diffuse from the transfer to the receiver sheet and thus the amount of dye transferred onto, and the depth of shade at, any discrete area on the receiver sheet will depend on the period for which a pixel is heated while it is in contact with the reverse side of the transfer sheet.

As heat is applied through individually energised pixels for very short periods of time, conditions are adiabatic, the process is selective in terms of location and quantity of dye transferred and the transferred dye remains close to the surface of the receiver sheet.

It is clear that there are significant distinctions between TTP onto synthetic textile materials and DDTTP onto smooth polymeric surfaces and thus dyes which are suitable for the former process are not necessarily suitable for the latter.

In DDTTP it is important that the surfaces of the transfer sheet and receiver sheet are even so that good contact can be achieved between the printed surface of the transfer sheet and the receiving surface of the receiver sheet over the entire printing area because it is believed that the dye is transferred substantially by diffusion. Thus, any defect or speck of dust which prevents good contact over any part of the printing area will inhibit transfer and produce an unprinted portion on the receiver sheet which can be considerably larger than the area of the speck or defect. The receiving surfaces of the substrate of the transfer and receiver sheets are usually a smooth polymeric film, especially of a polyester, which has some affinity for the dye.

Important criteria in the selection of a dye or dye mixture for DDTTP are its thermal properties, brightness of shade, fastness properties, such as light fastness, and facility for application to the substrate in the preparation of the transfer sheet. For suitable performance the dye or dye mixture should transfer evenly and rapidly, in proportion to the heat applied to the transfer sheet so that the depth of shade on the receiver sheet is proportional to the heat applied and a true grey scale of coloration can be achieved on the receiver sheet. After transfer the dye or dye mixture should preferably not migrate or crystallise and have excellent fastness to light, heat, rubbing, especially rubbing with a oily or greasy object, e.g. a human finger, such as would be encountered in normal handling of of the printed receiver sheet. Full colour DDTTP is generally an additive trichromatic process and therefore brightness of shade is important in order to achieve as wide a range of colours from the three primary shades of yellow, magenta and cyan. However, it may be desirable to obtain certain other shades, such as navies and blacks, using single or pre-mixed dyes, rather than to develop these from the normal yellow, magenta and cyan trichromat. As the dye or dye mixture should be sufficiently mobile to migrate from the transfer sheet to the receiver sheet at the temperatures employed, 100°–400° C., in the short time-scale, generally <20 msec, it is preferably free from ionic and water-solubilising groups, and is thus not readily soluble in aqueous or water-miscible media, such as water and ethanol. Many potentially suitable dyes are also not readily soluble in the solvents which are commonly used in, and thus acceptable to, the printing industry; for example, alcohols such as i-propanol, ketones such as methyl ethyl ketone (MEK), methyl i-butyl ketone (MIBK) and cyclohexanone, ethers such as tetrahydrofuran and aromatic hydrocarbons such as toluene. Although the dye can be applied as a dispersion in a suitable solvent, it has been found that brighter, glossier and smoother final prints can be achieved on the receiver sheet if the dye or dye mixture is applied to the substrate from a solution. In order to achieve the potential for a deep shade on the receiver sheet it is desirable that the dye or dye mixture should be readily soluble in the ink medium. It is also important that a dye or dye mixture which has been applied to a transfer sheet from a solution should be resistant to crystallisation so that it remains as an amorphous layer on the transfer sheet for a considerable time. Crystallisation not only produces defects which prevent good contact between the transfer receiver sheet but gives rise to uneven prints.

The following combination of properties is highly desirable for a dye or dye mixture which is to be used in DDTTP:

Ideal spectral characteristics (narrow absorption curve with absorption maximum matching a photographic filter)

High tinctorial strength.

Correct thermochemical properties (high thermal stability and efficient transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (resistant to heat, migration, crystallisation, grease, rubbing and light).

The achievement of good light fastness in DDTTP is extremely difficult because of the unfavourable environment of the dye, close to the surface of the polyester receiver sheet. Many known dyes for polyester fibre with high light fastness (>6 on the International Scale of 1–8) on polyester fibre when applied by TTP when penetration into the fibres is good, exhibit very poor light fastness on a polyester receiver sheet when applied to DDTTP.

It has now been found that certain azopyridone dye mixtures give prints with enhanced storage stability and grease resistance over prints produced with the individual dyes.

THE INVENTION

According to a first aspect of the invention, there is provided a thermal transfer printing sheet comprising a substrate having a coating comprising a mixture of dyes of 20–50% of Formula I and of 80–50% of Formula II:

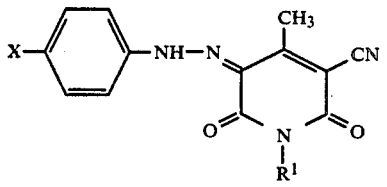

I

-continued

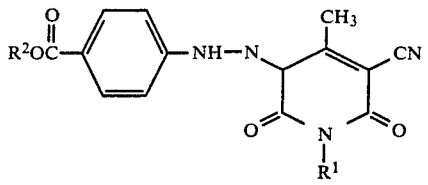

II wherein:

$R^1$ is $C_{1-12}$-alkyl;

X is halogen; and $R^2$ is aryl or $C_{1-4}$-alkyl unsubstituted or substituted by $C_{1-4}$-alkoxy, $C_{1-4}$-alkoxy-$C_{1-4}$-alkoxy- or aryl.

The Coating

The coating suitably comprises a binder together with a mixture of dyes of Formula I and Formula II. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye mixtures to the substrate which has acceptable solubility in the ink medium, i.e. the medium in which the dye mixture and binder are applied to the transfer sheet. It is preferred however, that the dye mixture is soluble in the binder so that it can exist as a solid solution in the binder on the transfer sheet. In this form it is generally more resistant to migration and crystallisation during storage. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used. It is also preferred to use a binder which is soluble in one of the above-mentioned commercially acceptable organic solvents. Preferred binders of this type are EHEC, particularly the low and extra-low viscosity grades, and ethyl cellulose.

The Dye of Formula I and Formula II

In the dyes of Formula I and Formula II, $R^1$ is preferably $C_{1-6}$-alkyl, more preferably $C_{1-4}$-alkyl, and especially ethyl or n-butyl; alkyl groups having 3 or more carbon atoms can be straight-chain or branched. In the dye of Formula I, X may be fluorine, bromine or iodine but is preferably chlorine. In the dye of Formula II, $R^2$ is preferably $C_{1-4}$-alkoxy-$C_{1-4}$-alkyl, for example 2-methoxyethyl, 2-ethoxyethyl or 2-butoxyethyl, $C_{1-4}$- alkoxy-$C_{1-4}$-alkoxy-$C_{1-4}$-alkyl, for example 2-(2-methoxyethoxy)ethyl or 2-(2-butoxyethoxy)ethyl or phenyl-$C_{1-4}$-alkyl, especially benzyl.

It is especially preferred that $R^2$ is $CH_3OC_2H_4OC_2H_4$.

A specific example of a dye of Formula I is:

Dye A

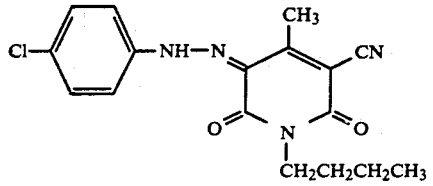

A specific example of a dye of Formula II is:

Dye B

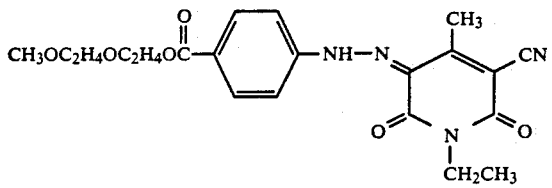

The dye mixtures of Formula I and Formula II have particularly good thermal properties giving rise to even prints on the receiver sheet, whose depth of shade is accurately proportional to the quantity of applied heat so that a true grey scale of coloration can be attained.

The dye mixtures of Formula I and Formula II also have strong coloristic properties and good solubility in a wide range of solvents, especially those solvents which are widely used and accepted in the printing industry, for example, alkanols, such as i-propanol and butanol; aromatic hydrocarbons, such as toluene, and ketones such as MEK, MIBK and cyclohexanone. This produces inks (solvent plus dye mixture and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and an even yellow shade which is fast to both light and heat and the effects of finger grease.

The Substrate

The substrate may be any sheet material preferably having at least one smooth even surface and capable of withstanding the temperatures involved in DDTTP, i.e. up to 400° C. for periods up to 20 msec, yet thin enough to transmit heat applied on one side through to the dyes on the other side to effect transfer of the dye onto a receiver sheet within such short periods. Examples of suitable materials are polymers, especially polyester, polyacrylate, polyamide, cellulosic and polyalkylene films, metallised forms thereof, including co-polymer and laminated films, especially laminates incorporating a smooth even polyester receptor layer on which the dye is deposited. Thin (<20 micron) high quality paper of even thickness and having a smooth coated surface, such as capacitor paper, is also suitable. A laminated substrate preferably comprises a backcoat, on the opposite side of the laminate from the receptor layer, of a heat resistant material, such as a thermosetting resin, e.g a silicone, acrylate or polyurethane resin, to separate the heat source from the polyester and prevent melting of the latter during the DDTTP operation. The thickness of the substrate depends to some extent upon its thermal conductivity but it is preferably less than 20 μm and more preferably less than 10 μm.

The DDTTP Process

According to a further feature of the present invention there is provided a dye diffusion thermal transfer printing process which comprises contacting a transfer sheet comprising a coating comprising a dye mixture of Formula I and Formula II with a receiver sheet, so that the coating is in contact with the receiver sheet and selectively applying heat to discrete areas on the reverse side of the transfer sheet whereby the dye mixture on the opposite side of the sheet to the heated areas is transferred to the receiver sheet.

Heating in the selected areas can be effected by contact with heating elements (pixels), which can be heated to 200°–450° C., preferably 200°–400° C., over periods of 2 to 10 msec, whereby the dye mixture may be heated to 150°–300° C., depending on the time of exposure, and thereby caused to transfer, substantially by diffusion, from the transfer to the receiver sheet. Good contact between dyes and receiver sheet at the point of application is essential to effect transfer. The density of the printed image is related to the time period for which the transfer sheet is heated.

The Receiver Sheet

The receiver sheet conveniently comprises a polyester sheet material, especially a white polyester film, preferably of polyethylene terephthalate (PET). Although some dyes of Formula I and Formula II are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye mixture is applied, into which the dye mixture more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dye mixtures of Formula I and Formula II give particularly strong and good quality prints (e.g. fast to light, heat and storage) on any specific transfer or receiver sheet, compared with other dyes of similar structure which have been proposed for thermal transfer printing processes. The design of receiver and transfer sheets is discussed further in EP 133,011 and EP 133012.

The invention is further illustrated by the following examples in which all parts and percentages are by weight.

INK 1

This was prepared by dissolving 4.76 parts of Dye A, 4.76 parts of polyvinylbutyral (BXI, Sekisui) and 1.19 parts of ethyl cellulose ($T_{10}$, Hercules) in 89.29 parts of tetrahydrofuran (THF) and stirring the mixture until a homogeneous solution was obtained.

INK 2

This was prepared by the same method as Ink 1 except that 10% of the weight of Dye A was replaced by an equal weight of Dye B.

INKS 3 TO 11

These were prepared in the same manner as Ink 2 except that for each successive ink a further 10% of the original weight of Dye A in Ink 1 was replaced by an equal weight of Dye B, so that Ink 11 contained 4.76 parts of Dye B and no Dye A.

TRANSFER SHEET TS1

This was prepared by applying Ink 1 to a 6 μm polyethylene terephthalate sheet (substrate) using a wire-wound metal Meyer-bar (K-bar No 3) to produce a wet film of ink on the surface of the sheet. The ink was then dried with hot air to give a 3 micrometer dry film on the surface of the substrate.

TRANSFER SHEETS TS2-TS11

These were prepared in the same manner as TS1 using each of Inks 2-11 in place of Ink 1. TS6, TS7, TS8 and TS9 comprising a substrate coated with an inks containing mixtures of Dye A and Dye B in the ratios 50:50, 40:60, 30:70 and 20:80 respectively constitute Examples 1 to 4 of the invention.

PRINTED RECEIVER SHEET RS1

A sample of TS 1 was contacted with a receiver sheet, comprising a composite structure based in a white polyester base having a receptive coating layer on the side in contact with the printed surface of TS 1. The receiver and transfer sheets were placed together on the drum of a transfer printing machine and passed over a matrix of closely-spaced pixels which were selectively heated in accordance with a pattern information signal to a temperature of >300° C. for periods from 2 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet.

PRINTED RECEIVER SHEETS RS2 TO RS11

These were prepared in the same way as RS1 using TS2 to TS11 in place of TS1. RS6, RS7, RS8 and RS9 constitute Examples 5 to 8 of the present invention.

EVALUATION OF INKS, TRANSFER SHEETS AND PRINTED RECEIVER SHEETS

The stability of the ink and the quality of the print on the transfer sheet was assessed by visual inspection. An ink was considered stable if there was no precipitation over a period of two weeks at ambient and a transfer sheet was considered stable if it remained substantially free from crystallisation for a similar period.

The storage stability of the inks on the receiver sheets was evaluated in respect of the change in optical density (OD), measured with a Sakura Digital densitometer, after 13 days at 45° C. and 85% relative humidity. The results of the evaluation, shown in the following Table, are expressed as the percentage change in optical density (% OD).

Table

| Example | RS1 | % Dye A | % Dye B | % OD |
|---|---|---|---|---|
| | 1 | 100 | 0 | −17.4 |
| | 2 | 90 | 10 | −19.2 |
| | 3 | 80 | 20 | −6.1 |
| | 4 | 70 | 30 | −4.4 |
| | 5 | 60 | 40 | −8.6 |
| 5 | 6 | 50 | 50 | +1.0 |
| 6 | 7 | 40 | 60 | +2.0 |
| 7 | 8 | 30 | 70 | +0.9 |
| 8 | 9 | 20 | 80 | +4.3 |
| | 10 | 10 | 90 | −2.3 |
| | 11 | 0 | 100 | −2.1 |

We claim:

1. A thermal transfer printing sheet comprising a substrate having a coating comprising a mixture of dyes of 20–50% of Formula I and of 80–50% of Formula II.

I

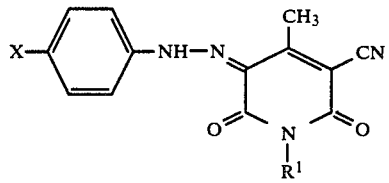

II

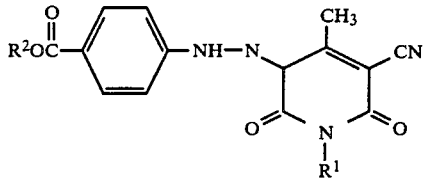

wherein:

$R^1$ is $C_{1-12}$-alkyl;

X is halogen; and $R^2$ is aryl or $C_{1-4}$-alkyl unsubstituted or substituted by $C_{1-4}$-alkoxy, $C_{1-4}$-alkoxy-$C_{1-4}$-alkoxy or aryl.

2. A thermal transfer printing sheet according to claim 1 wherein in the dye of Formula I, $R^1$ is n-butyl and X is Cl.

3. A thermal transfer printing sheet according to claim 1 in which in the dye of Formula II, $R^1$ is ethyl and $R^2$ is $CH_3OC_2H_4OC_2H_4$—.

4. A transfer printing process which comprises contacting a transfer sheet according to any one of claims 1 to 3 with a receiver sheet, so that the dye is in contact with the receiver sheet and selectively heating areas of the transfer sheet whereby dye in the heated areas of the transfer sheet may be transferred to the receiver sheet.

5. A transfer printing process according to claim 4 wherein the transfer sheet is heated to a temperature from 300° C. to 400° C. for a period of 1 to 10 milliseconds while in contact with the receiver sheet.

6. A transfer printing process according to claim 5 wherein the receiver sheet is white polyester film.

7. A transfer printing process according to claim 4 wherein the receiver sheet is white polyester film.

* * * * *